United States Patent [19]

Knox

[11] 4,357,177

[45] Nov. 2, 1982

[54] WHEELED ADAPTER BASE FOR UPRIGHT VACUUM CLEANERS

[76] Inventor: Robert D. Knox, 2910 Webster St., Fort Wayne, Ind. 46807

[21] Appl. No.: 254,946

[22] Filed: Apr. 16, 1981

[51] Int. Cl.[3] ..... A47L 9/00

[52] U.S. Cl. ..... 134/21; 15/323; 15/327 F; 15/338

[58] Field of Search ..... 15/328, 323, 327 F, 15/338; 134/21

[56] References Cited

U.S. PATENT DOCUMENTS

| | | | |
|---|---|---|---|
| 1,756,519 | 4/1930 | Moore | 15/328 |
| 2,920,337 | 1/1960 | Smith | 15/323 |
| 3,015,123 | 1/1962 | Descarries | 15/327 F |
| 3,955,237 | 5/1976 | Chateauneuf et al. | 15/323 |
| 4,008,505 | 2/1977 | Clowers | 15/338 |

FOREIGN PATENT DOCUMENTS

| | | | |
|---|---|---|---|
| 462502 | 3/1951 | Italy | 15/338 |
| 566342 | 8/1957 | Italy | 15/338 |

*Primary Examiner*—Chris K. Moore
*Attorney, Agent, or Firm*—Roger M. Rickert

[57] ABSTRACT

An upright vacuum cleaner conversion and storage pedestal for receiving and supporting a vacuum cleaner and adapting the cleaner to flexible hose cleaning tasks is disclosed having a wheeled base or bed releasably fastenable to the bottom of the cleaner with a vacuum transmitting conduit in the base positionable in substantially airtight relation with the suction mouth of the cleaner and communicating with a coupler for joining a flexible air hose to the conduit so that the pedestal supported cleaner may be used in much the same manner as a conventional canister type cleaner. A leg may be pivotably supported beneath the base, movable between a stowed horizontal position and an extended position for supporting the cleaner and pedestal on a stairway with wheels of the base resting on one step surface and the leg resting on the next lower step surface so as to adapt the upright vacuum cleaner to vacuuming stairways and the like. The pedestal or base may extend laterally beyond a supported cleaner and include attachment arrangements for supporting cleaner accessories. A quick release cam arrangement may be provided for securing the cleaner to the pedestal a method of adapting an upright vacuum cleaner for vacuuming stairways is also disclosed.

9 Claims, 4 Drawing Figures

WHEELED ADAPTER BASE FOR UPRIGHT VACUUM CLEANERS

BACKGROUND OF THE INVENTION

The present invention relates generally to vacuum cleaners and more particularly to a mobile adapter pedestal and accessory caddy for an upright type vacuum cleaner to adapt such an upright vacuum cleaner to above the floor cleaning tasks.

Early vacuum cleaners were typically of the upright variety having, for example, four wheels rollably supporting the cleaner with the suction mouth thereof in close proximity to the floor or carpet being vacuumed and with a handle extending upwardly from the base portion of the cleaner for operator control thereof. Such upright vacuum cleaners are well suited to vacuuming carpets and other horizontal surfaces, however, for off the floor vacuuming tasks, a canister type vacuum cleaner is preferred. The canister type cleaners have the entire vacuum structure supported on wheels or skids with a flexible vacuum hose extending from the canister and under operator control for the vacuuming tasks. With such a canister and flexible hose arrangement the vacuuming of stairs, upholstered furniture and the like is facilitated.

There have been numerous attempts to adapt the upright type vacuum cleaner to a flexible hose configuration, however, few have met with commercial success. The homeowner is therefore still faced with the dilemma of which type vacuum cleaner to purchase and while the consumer is frequently well acquainted with the advantages and disadvantages of each type, that consumer is still faced with a decision which is at best a compromise.

SUMMARY OF THE INVENTION

Among the several objects of the present invention may be noted the reconciliation of the above conflicting considerations in the purchase of a vacuum cleaner; the provision of a method of adapting an upright vacuum cleaner to the vacuuming of stairways and the like by providing a foldable leg which when extended supports the vacuum cleaner base on one step with the leg resting on the next lower step; the provision of a piggy-back conversion arrangement to make an upright vacuum cleaner behave like a canister type vacuum cleaner; the provision of a tray-like upright vacuum cleaner adapter pedestal for converting an upright vacuum cleaner to a flexible vacuum hose operation while providing an accessory caddy for the more commonly used vacuum accessories; and the minimization of the adversities associated with upright and canister type vacuum cleaners while obtaining the advantages of each type in a single unit. These as well as other objects and advantageous features of the present invention will be in part apparent and in part pointed out hereinafter.

In general a vacuum cleaner adapter pedestal includes a cleaner supporting bed having depressions for accepting cleaner wheels and an opening for fitting snugly adjacent the suction mouth of the cleaner when the cleaner is positioned on the bed and a conduit leading from the opening to a flexible air hose coupler to transmit suction from the cleaner to a flexible air hose. A plurality of wheels are located beneath the bed to rollably support the bed and a quick release securing arrangement fastens the cleaner in position on the bed. A pivotable leg beneath the bed may be provided so that the bed and supported cleaner may be readily positioned on a stairway.

Also in general and in one form of the invention a tray-like upright vacuum cleaner converter for supporting a cleaner and adapting the cleaner to flexible hose cleaning tasks includes a wheeled base which may be releasably fastened to the bottom of the cleaner having a vacuum transmitting conduit to be placed in airtight relation with the suction mouth of the cleaner for joining a flexible hose to the cleaner with the base also providing for the storage of cleaner accessories.

Still further in general and in one form of the invention an upright vacuum cleaner is adapted to vacuuming stairways and the like by extending a normally horizontally stowed leg into a generally vertical direction, partially supporting the cleaner on a step surface with a portion of the cleaner overhanging that step surface and the leg extending downwardly from that overhanging portion to engage and support at least a portion of the cleaner on the next lower step surface, coupling a flexible air transmitting hose to the cleaner with a cleaning accessory fastened to the other hose end and vacuuming a plurality of steps before moving the cleaner to a position supported on a different pair of adjacent step surfaces.

BRIEF DESCRIPTION OF THE DRAWING

Corresponding reference numerals indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
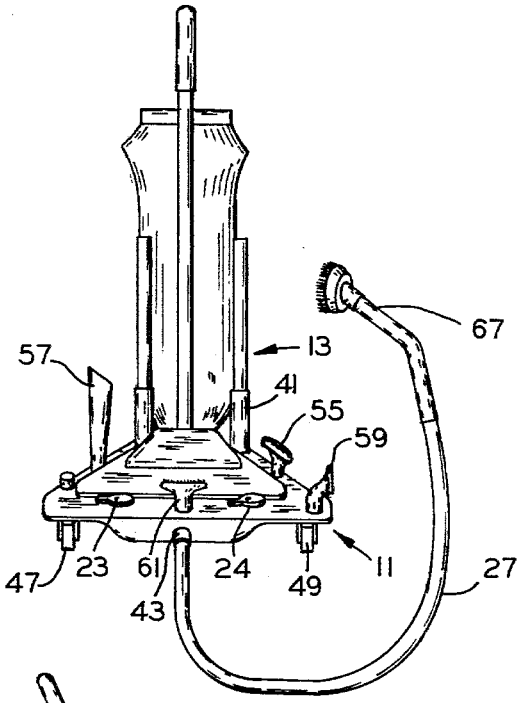
FIG. 1 is a front elevation view of an upright vacuum cleaner positioned on a mobile adapter pedestal and accessory caddy with a flexible air hose and cleaning accessory coupled thereto for an off the floor cleaning operation.
Figure 2:
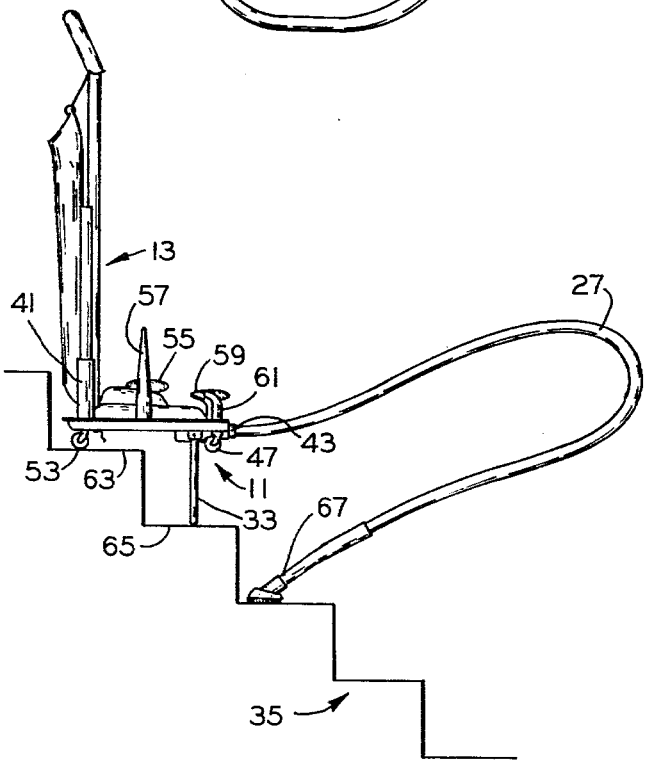
FIG. 2 is a side elevation view of the cleaner and pedestal of FIG. 1 illustrating a pivotable support leg extended so that the bed and associated cleaner are supported on a stairway with some pedestal cleaners resting on one step surface and the leg resting on the next lower step surface.
Figure 3:
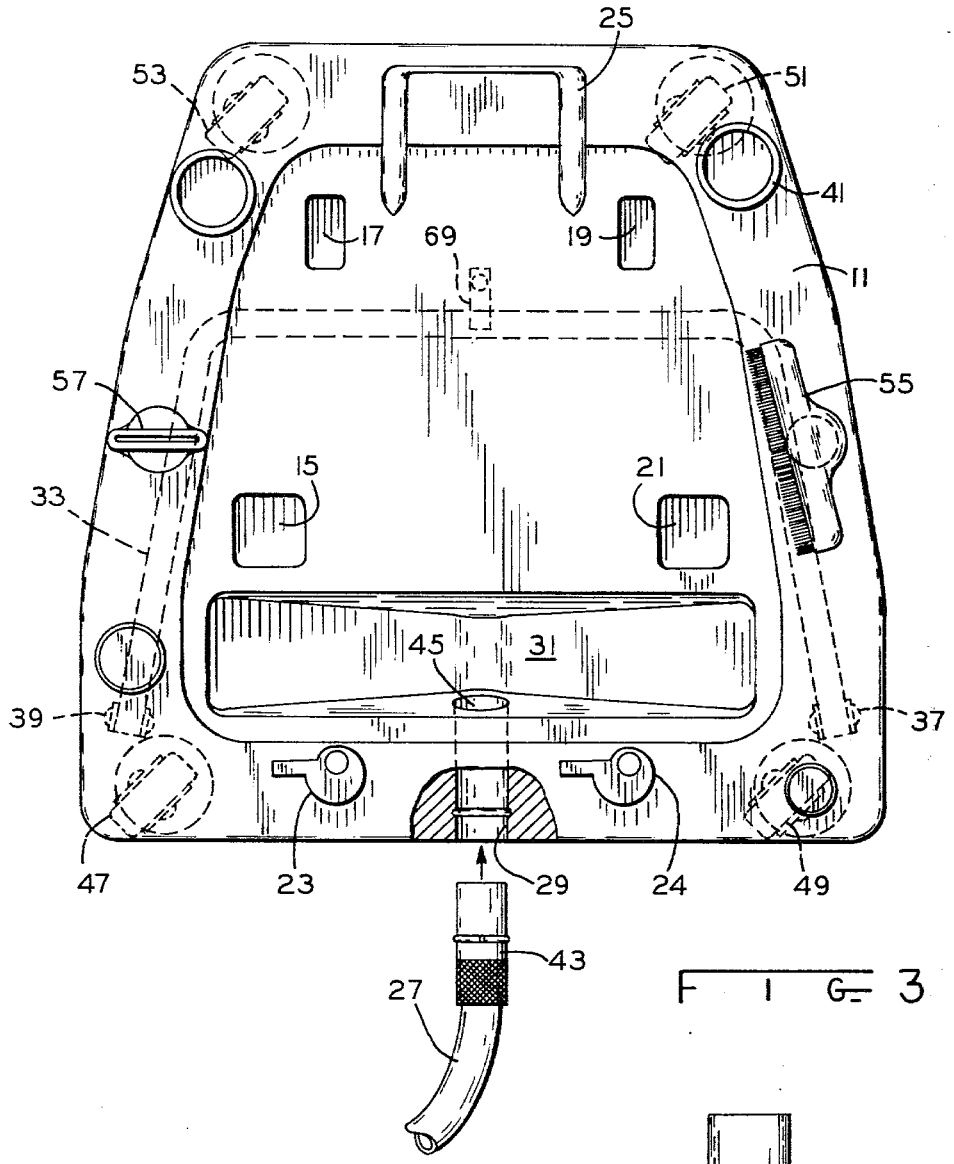
FIG. 3 is a top view of the adapter pedestal of FIGS. 1 and 2.
Figure 4:
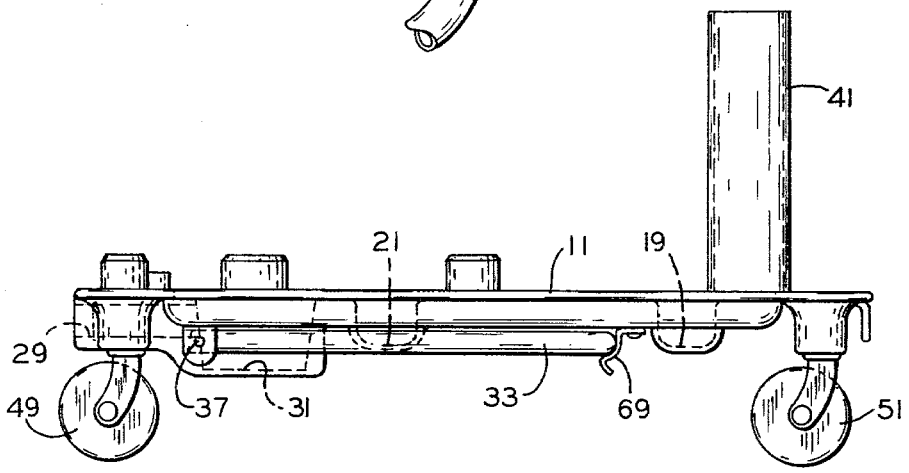
FIG. 4 is a side view of the adapter pedestal of FIGS. 1 through 3.

Referring to the drawing generally there is illustrated a base arrangement 11 for a conventional upright vacuum cleaner 13 wherein the vacuum cleaner may be set on the base 11 with the conventional vacuum cleaner wheels seated in depressions 15, 17, 19 and 21 and with front and rear retainers 23 and 25 attaching the vacuum cleaner to the base in a secure manner. The base 11 thus provides an adapter for a flexible vacuum hose 27 with that hose being coupled by way of opening 29 to opening 31 which fits closely adjacent the vacuum cleaner suction mouth. This opening 31 thus seals in relatively airtight fashion to the bottom of the upright vacuum cleaner. A U-shaped folding leg 33 for supporting the base on a stairway 35 may be provided which is pivoted at pivot pins 37 and 39 near opposite U ends and between the extended position illustrated in FIG. 2 and the stowed position illustrated in FIGS. 3 and 4. The leg, when extended, allows the vacuum cleaner to be supported on adjacent steps as illustrated in FIG. 2.

Tubes such as 41 and or depressions may be provided about the base outside the area occupied by the bottom portion of the upright vacuum cleaner for stowing cleaning accessories.

The base 11 functions as an adapter pedestal and accessory caddy for the upright vacuum cleaner 13 and is configured as a cleaner supporting bed having a plurality of depressions 15, 17, 19 and 21 for accepting the cleaner wheels along with an opening 31 for fitting snugly adjacent the suction mouth of the cleaner when the cleaner is supported in position on the bed. A coupler 29 receives a mating coupling unit 43 of a flexible air hose 27 with opening 29 being connected by way of conduit 45 to opening 31 to transmit suction from the cleaner 13 to the flexible air hose 27. The adapter pedestal is made mobile by the provision of a plurality of wheels 47, 49, 51 and 53 beneath the bed for rollably supporting the bed. These wheels may be caster type wheels as illustrated or some, typically the rear wheels 51 and 53, may be of the non-pivoting variety.

The cleaner may be secured in position on the bed by providing a slidable clip fastener 25 near the rear of the cleaner which overlies an upper surface or ledge of the cleaner and by the pivotable cams 23 and 24 which in the position illustrated clear an upper ledge of the cleaner, however, when rotated counterclockwise about ½ turn, overlie another upper surface of the cleaner to securely clamp the cleaner to the base. It will be noted in FIG. 3 that the bed extends laterally beyond the supported cleaner with the laterally extending bed portions including the tubes such as 41 and similar structures for supporting cleaner accessories. Thus, for example, the caddy may support a wall brush 55, a crevice tool 57, a dusting brush 59 and upholstery cleaning tool 61, or other combination of accessories as desired. The accessories may of course be positioned as desired and there is no unique location for a given accessory.

The horizontal dimensions of the typical upright type vacuum cleaner exceed the horizontal depth of a typical stair step and the supporting of either upright or canister type vacuum cleaners on a stairway is an arduous task. The provision of an extendible leg either in conjunction with the cleaner conversion and storage pedestal or as an integral part of an upright cleaner substantially facilitates stairway cleaning operations and the user need only extend the normally horizontally stowed leg 33 to a generally vertical direction and then partially support the cleaner as by the rear wheels 51 and 53 on a step surface 63, as illustrated in FIG. 2, with a portion of the cleaner overhanging step surface 63, and leg 33 extending downwardly from that overhanging portion to engage the next lower step surface 65, partially supporting the cleaner thereon. Then with a flexible air hose, such as 27, coupled to a suction inlet of the cleaner, and a cleaning accessory, such as 67, coupled to the hose and remote from the cleaner, a plurality of steps may be vacuumed before the cleaner is moved to a position supported on a different pair of adjacent surfaces.

As applied to the base 11, this leg may be of a generally U-shaped configuration and held in its stowed or horizontal position by a spring retainer clip 69. It is also possible to employ the resilience of the U-shaped leg itself in conjunction with detents near the pivot points 37 and 39 so that the leg will be held in either the stowed or extended position, as desired. Regardless of the particular structure employed, the leg should be yieldably retained in the stowed position so as to not interfere with horizontal surface cleaning operations.

It is contemplated that the base 11 may be manufactured by the vacuum forming of plastic materials to provide a relatively inexpensive adapter pedestal, however, a wide variety of materials and manufacturing techniques are applicable to this vacuum cleaner conversion and storage pedestal arrangement.

From the foregoing it is not apparent that a novel mobile adapter pedestal and accessory caddy for an upright vacuum cleaner, as well as a novel approach to the problem of vacuuming stairways, have been disclosed meeting the objects and advantageous features set out hereinbefore as well as others and that modifications as to the precise configurations, shapes and details may be made by those having ordinary skill in the art without departing from the spirit of the invention or the scope thereof as set out by the claims which follow.

What is claimed is:

1. A mobile adapter pedestal and accessory caddy for an upright vacuum cleaner comprising:

a cleaner supporting bed having a plurality of depressions for accepting cleaner wheels, an opening for fitting snugly adjacent the suction mouth of the cleaner when the cleaner is supported in position on the bed, a coupler for receiving a flexible air hose, and a conduit leading from the opening to the coupler to transmit suction from the cleaner to a flexible air hose;

a plurality of wheels beneath the bed for rollably supporting the bed;

means for securing a cleaner in position on the bed with the cleaner wheels in the bed depressions and the cleaner suction mouth juxtaposed with the opening; and a generally U-shaped leg pivotably supported beneath the bed and movable between a stowed position lying generally flat against the bottom of the bed in a generally horizontal attitude and an extended position to support the bed and associated cleaner on a stairway with some of the plurality of wheels resting on one step surface and the leg resting on the next lower step surface.

2. The device of claim 1 wherein at least some of the set of wheels beneath the bed are caster wheels.

3. The device of claim 1 wherein the U-shaped leg is pivotably attached to the underside of the bed near the U ends and further comprising means yieldably retaining the leg in the stowed position.

4. A traylike upright vacuum cleaner conversion and storage pedestal for receiving and supporting a cleaner and adapting the cleaner to flexible hose cleaning tasks comprising a wheeled base releasably fastenable to the bottom of the cleaner, a vacuum transmitting conduit in the base adapted to be placed in substantially air-tight relation with the suction mouth of the cleaner, a coupler for joining a flexible air hose to the conduit, and a leg pivotably supported beneath the base and movable between a stowed generally horizontal position and an extended position to support a cleaner and the pedestal on a stairway with certain base wheels resting on one step surface and the leg resting on the next lower step surface.

5. The pedestal of claim 4 wherein the leg is generally U-shaped and pivotably attached to the underside of the base near the U ends and further comprising means yieldably retaining the leg in the stowed position.

6. The pedestal of claim 4 wherein the base extends laterally beyond a supported cleaner, the laterally extending base portion including means for supporting cleaner accessories.

7. The method of adapting an upright vacuum cleaner for vacuuming stairways comprising the steps of:

extending a normally horizontally stowed leg to a generally vertical direction;

partially supporting the cleaner on a step surface with a portion of the cleaner overhanging the step surface and the leg extending downwardly from that overhanging portion to engage and partially support the cleaner on the next lower step surface;

coupling a flexible air transmitting hose to a cleaner suction inlet and a cleaning accessory to the hose end remote from the cleaner suction inlet; and vacuuming a plurality of steps before moving the cleaner to a position supported on a different pair of adjacent step surfaces.

8. A mobile adapter pedestal and accessory caddy for an upright vacuum cleaner comprising:

a cleaner supporting bed having a plurality of depressions for accepting cleaner wheels, an opening for fitting snugly adjacent the suction mouth of the cleaner when the cleaner is supported in position on the bed, a coupler for receiving a flexible air hose, and a conduit leading from the opening to the coupler to transmit suction from the cleaner to a flexible air hose, the bed extending laterally beyond a supported cleaner, the laterally extending bed portion including means for supporting cleaner accessories;

a plurality of wheels beneath the bed for rollably supporting the bed; and means for securing a cleaner in position on the bed with the cleaner wheels in the bed depressions and the cleaner suction mouth juxtaposed with the opening.

9. A mobile adapter pedestal and accessory caddy for an upright vacuum cleaner comprising:

a cleaner supporting bed having a plurality of depressions for accepting cleaner wheels, an opening for fitting snugly adjacent the suction mouth of the cleaner when the cleaner is supported in position on the bed, a coupler for receiving a flexible air hose, and a conduit leading from the opening to the coupler to transmit suction from the cleaner to a flexible air hose;

a plurality of wheels beneath the bed for rollably supporting the bid; and means for securing a cleaner in position on the bed with the cleaner wheels in the bed depressions and the cleaner suction mouth juxtaposed with the opening, comprising cam means selectively actuable to clear and to overlap an upper ledge of the cleaner.

* * * * *